US010633730B2

(12) United States Patent
Ta et al.

(10) Patent No.: US 10,633,730 B2
(45) Date of Patent: *Apr. 28, 2020

(54) MATERIAL FOR COLD-ROLLED STAINLESS STEEL SHEET

(71) Applicant: JFE STEEL CORPORATION, Tokyo (JP)

(72) Inventors: Ayako Ta, Chiba (JP); Yukihiro Matsubara, Kurashiki (JP); Yukio Kimura, Fukuyama (JP); Masataka Yoshino, Chiba (JP); Keisuke Nakazono, Chiba (JP); Sumio Kaiho, Chiba (JP); Saiichi Murata, Chiba (JP); Nobukazu Kitagawa, Chiba (JP)

(73) Assignee: JFE Steel Corporation, Tokyo (JP)

( * ) Notice: Subject to any disclaimer, the term of this patent is extended or adjusted under 35 U.S.C. 154(b) by 319 days.

This patent is subject to a terminal disclaimer.

(21) Appl. No.: 15/508,665

(22) PCT Filed: Jul. 2, 2015

(86) PCT No.: PCT/JP2015/003342

§ 371 (c)(1),
(2) Date: Mar. 3, 2017

(87) PCT Pub. No.: WO2016/035235

PCT Pub. Date: Mar. 10, 2016

(65) Prior Publication Data

US 2017/0275744 A1 Sep. 28, 2017

(30) Foreign Application Priority Data

Sep. 5, 2014 (JP) ..... 2014-181022

(51) Int. Cl.

| | |
|---|---|
| ***C21D 9/46*** | (2006.01) |
| ***C22C 38/54*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/42*** | (2006.01) |
| ***C22C 38/44*** | (2006.01) |
| ***C22C 38/46*** | (2006.01) |
| ***C22C 38/48*** | (2006.01) |

(Continued)

(52) U.S. Cl.

CPC ..... *C22C 38/54* (2013.01); *C21D 6/004* (2013.01); *C21D 6/005* (2013.01); *C21D 6/007* (2013.01); *C21D 6/008* (2013.01); *C21D 8/0205* (2013.01); *C21D 8/0226* (2013.01); *C21D 8/0236* (2013.01); *C21D 8/0273* (2013.01); *C21D 9/46* (2013.01); *C22C 38/00* (2013.01); *C22C 38/001* (2013.01); *C22C 38/002* (2013.01); *C22C 38/005* (2013.01); *C22C 38/02* (2013.01); *C22C 38/04* (2013.01); *C22C 38/06* (2013.01); *C22C 38/18* (2013.01); *C22C 38/42* (2013.01); *C22C 38/44* (2013.01); *C22C 38/46* (2013.01); *C22C 38/48* (2013.01); *C22C 38/50* (2013.01); *C22C 38/52* (2013.01); *C21D 8/02* (2013.01); *C21D 2211/005* (2013.01); *C21D 2211/008* (2013.01); *C22C 38/004* (2013.01); *C22C 38/08* (2013.01); *C22C 38/10* (2013.01); *C22C 38/105* (2013.01); *C22C 38/12* (2013.01); *C22C 38/14* (2013.01); *C22C 38/16* (2013.01); *C22C 38/20* (2013.01); *C22C 38/24* (2013.01); *C22C 38/26* (2013.01); *C22C 38/28* (2013.01); *C22C 38/30* (2013.01); *C22C 38/40* (2013.01)

(58) Field of Classification Search

CPC ..... C21D 2211/005; C21D 2211/008; C21D 6/004; C21D 8/0236; C21D 9/46; C22C 38/00

USPC ..... 148/320

See application file for complete search history.

(56) References Cited

U.S. PATENT DOCUMENTS

| | | | | |
|---|---|---|---|---|
| 5,624,504 | A | 4/1997 | Miyakusu et al. | |
| 6,911,098 | B2 * | 6/2005 | Yazawa | C21D 8/0405 148/325 |

(Continued)

FOREIGN PATENT DOCUMENTS

| | | |
|---|---|---|
| CN | 1550565 A | 12/2004 |
| EP | 1477574 A2 | 11/2004 |

(Continued)

OTHER PUBLICATIONS

International Search Report and Written Opinion for International Application No. PCT/JP2015/003342, dated Sep. 15, 2015 6 Pages.

(Continued)

*Primary Examiner* — Jie Yang
(74) *Attorney, Agent, or Firm* — RatnerPrestia

(57) ABSTRACT

Provided is a material for a cold-rolled stainless steel sheet having a chemical composition containing, by mass %, C: 0.01% to 0.05%, Si: 0.02% to 0.75%, Mn: 0.1% to 1.0%, P: 0.04% or less, S: 0.01% or less, Cr: 16.0% to 18.0%, Al: 0.001% to 0.10%, N: 0.01% to 0.06% and the balance being Fe and inevitable impurities. The material has a metallographic structure including a martensite phase having an area ratio of 5% to 50% and the balance being a ferrite phase. A ferrite phase in portions extending from surface layers of front and back surfaces of a steel sheet has an average grain diameter of 20 μm or more and 50 μm or less, and a ferrite phase in a central portion of the sheet includes an unrecrystallized ferrite phase.

4 Claims, No Drawings

(51) Int. Cl.

| | |
|---|---|
| ***C22C 38/50*** | (2006.01) |
| ***C22C 38/52*** | (2006.01) |
| ***C22C 38/18*** | (2006.01) |
| ***C21D 6/00*** | (2006.01) |
| ***C21D 8/02*** | (2006.01) |
| *C22C 38/24* | (2006.01) |
| *C22C 38/40* | (2006.01) |
| *C22C 38/08* | (2006.01) |
| *C22C 38/12* | (2006.01) |
| *C22C 38/26* | (2006.01) |
| *C22C 38/10* | (2006.01) |
| *C22C 38/14* | (2006.01) |
| *C22C 38/30* | (2006.01) |
| *C22C 38/16* | (2006.01) |
| *C22C 38/20* | (2006.01) |
| *C22C 38/28* | (2006.01) |

(56) References Cited

U.S. PATENT DOCUMENTS

| | | | | |
|---|---|---|---|---|
| 10,000,824 | B2 * | 6/2018 | Yoshino ..... | C21D 6/002 |
| 2013/0319583 | A1 | 12/2013 | Hatano et al. | |
| 2014/0216614 | A1 | 8/2014 | Hatano et al. | |
| 2017/0275744 | A1 | 9/2017 | Ta et al. | |
| 2017/0283923 | A1 | 10/2017 | Ta et al. | |

FOREIGN PATENT DOCUMENTS

| | | | |
|---|---|---|---|
| EP | 2554702 | A1 | 2/2013 |
| JP | 57155326 | A | 9/1982 |
| JP | 6256529 | A | 3/1987 |
| JP | 04236717 | A | 8/1992 |
| JP | 09111354 | A | 4/1997 |
| JP | H1046293 | A | 2/1998 |
| JP | 10330887 | A | 12/1998 |
| JP | 2000102802 | A | 4/2000 |
| JP | 2000265215 | A | 9/2000 |
| JP | 2001098327 | A | 4/2001 |
| JP | 2003293083 | A | 10/2003 |
| JP | 2004223536 | A | 8/2004 |
| JP | 2006328524 | A | 12/2006 |
| JP | 3922740 | B2 | 5/2007 |
| JP | 2007197786 | A | 8/2007 |
| JP | 2008088534 | A | 4/2008 |
| JP | 2008088535 | A | 4/2008 |
| JP | 2009275268 | A | 11/2009 |
| JP | 2010001504 | A | 1/2010 |
| JP | 2010047822 | A | 3/2010 |
| TW | 201202444 | A | 1/2012 |
| WO | 2014103722 | A1 | 7/2014 |

OTHER PUBLICATIONS

Korean Office Action for Korean Application No. 10-2017-7006038, dated Jun. 21, 2018, with Concise Statement of Relevance of Office Action, 5 pages.

Chinese Office Action for Chinese Application No. 201580047133.7, dated Jan. 17, 2018, including Concise Statement of Search Report, 7 pages.

Extended European Search Report for European Application No. 15837552.7, dated Jun. 12, 2017, 12 pages.

Taiwan Office Action for Taiwan Application No. 104122006, dated Mar. 1, 2016 with Concise Statement of Relevance of Office Action, 4 pages.

Non Final Office Action for U.S. Appl. No. 15/112,901, dated Nov. 3, 2017, 8 pages.

* cited by examiner

MATERIAL FOR COLD-ROLLED STAINLESS STEEL SHEET

CROSS REFERENCE TO RELATED APPLICATIONS

This is the U. S. National Phase application of PCT International Application No. PCT/JP2015/003342, filed Jul. 2, 2015, and claims priority to Japanese Patent Application No. 2014-181022, filed Sep. 5, 2014, the disclosures of each of these applications being incorporated herein by reference in their entireties for all purposes.

FIELD OF THE INVENTION

The present invention relates to a material for a cold-rolled stainless steel sheet, the material being suitable for manufacturing a cold-rolled ferritic stainless steel sheet which is excellent in terms of surface appearance quality and which has sufficient formability.

BACKGROUND OF THE INVENTION

Ferritic stainless steel (steel sheet), which is economical and excellent in terms of corrosion resistance, is used in various applications such as building materials, transportation instruments, home electrical appliances, kitchen equipment, and automobile parts, and the range of its application has been expanding in recent years. Of these applications, in applications in which surface appearance is important such as interior construction materials, bodies and doors of home electrical appliances, kitchen equipment, and molding for automobiles, good surface appearance is particularly emphasized.

Good surface appearance requires high surface glossiness and the absence of roping. Surface brightness varies depending on the color tone of a surface and the degree of light reflection, which vary depending on the fine irregularities of the surface; the smoother the sheet surface, the higher the brightness. In order to increase the brightness, it is necessary to reduce the fine irregularities of a steel sheet surface typified by rolling-induced defects (oil pits and scratched marks generated by the transfer of the polishing marks of rolls) in a cold rolling process. Roping is a defect unique to ferritic stainless steel and generated as irregularities extending in the rolling direction.

Moreover, when a forming process such as pressing is performed before use, no generation of ridging and surface roughening is also necessary. Ridging is a defect unique to ferritic stainless steel and generated as irregularities extending in the rolling direction. Surface roughening is caused by undulation of coarse crystal grains. Ridging or surface roughening generated in a forming work process needs to be removed by polishing, which results in a considerable increase in the manufacturing load and manufacturing costs.

In order to satisfy such requirements, regarding a technique of obtaining a cold-rolled stainless steel sheet excellent in terms of surface quality before and after a forming process, Patent Literature 1 discloses a ferritic stainless steel sheet having less planar anisotropy, being excellent in terms of ridging resistance and surface roughening resistance, and being characterized by subjecting steel containing, by mass %, C: 0.005% to 0.100%, Si: 0.01% to 2.00%, Mn: 0.01% to 2.00%, P: less than 0.040%, S: 0.03% or less, Cr: 10% to 22%, Al: 0.0005% to 0.2000%, and N: 0.005% to 0.080% to, as a heat treatment process after a hot rolling process, preliminary annealing and subsequently to main annealing, or to soaking treatment and further to partial transformation heat treatment at a high temperature of 900° C. to 1100° C. or more, or to cold rolling before heat treatment. Patent Literature 1 does not refer to surface gloss; however, since recrystallization of the ferrite phase is progressed by sufficient soaking time, softening occurs and the steel sheet surface tends to be deformed. Thus, the above-described rolling-induced defects are generated, which results in a deterioration in surface gloss. In addition, in Patent Literature 1, since recrystallization is sufficiently progressed, surface irregularities cannot be prevented from generating in a cold rolling process with enough tension, which results in generation of roping.

Patent Literature 2 discloses a ferritic stainless steel sheet that is excellent in terms of ridging resistance, workability, and surface brightness and that is obtained by controlling the sheet-thickness-direction length of colonies to be 30% or less of the thickness of the sheet. However, the method of controlling ferrite colonies in Patent Literature 2 does not reduce roping and the phenomenon of distortion of a reflected image on the surface visually observed still occurs.

Patent Literature 3 discloses a technique in which brightness is improved by decreasing the amount of oil drawn in order to reduce occurrence of oil pits and by minimizing the transfer of concave-convex patterns on the surfaces of rolls as a result of using hard low-surface-roughness work rolls in a cold rolling process. However, while the technique of Patent Literature 3 can remove rolling-induced surface defects, it cannot solve a problem of surface defects due to a raw material such as roping, ridging, and surface roughening.

Patent Literature

PTL 1: Japanese Unexamined Patent Application Publication No. 2006-328524

PTL 2: Japanese Unexamined Patent Application Publication No. 10-330887

PTL 3: Japanese Unexamined Patent Application Publication No. 2000-102802

SUMMARY OF THE INVENTION

An object of aspects of the present invention is, by solving the problems described above, to provide a material for a cold-rolled stainless steel sheet, the material being suitable for manufacturing a cold-rolled stainless steel sheet which is excellent in terms of surface appearance quality before and after a forming process and which has sufficient formability.

Here, in accordance with aspects of the present invention, the term "excellent in terms of surface appearance quality before a forming process" refers to a case of being excellent in terms of surface brightness and roping resistance. The term "excellent in terms of surface brightness" refers to a case where, when determining brightness of a test piece taken from the central portion in the width direction of a steel sheet at two points each in directions at angles of 0° and 90° to the rolling direction by using the reflected energy (Gs20°) of a light having an incidence angle of 20° in accordance with the prescription in JIS Z 8741, the average value of the determined values is 950 or more. The term "excellent in terms of roping resistance" refers to a case where, when determining surface roughness in a direction at an angle of 90° to the rolling direction in accordance with JIS B 0601-2001, Rz is 0.2 μm or less.

In addition, the term "excellent in terms of surface appearance quality after a forming process" refers to a case of being excellent in terms of ridging resistance and surface roughening resistance. The term "excellent in terms of ridging resistance" refers to a case where, after taking a JIS No. 5 tensile test piece, from the central portion in the width direction of a steel sheet, in a direction at an angle of 0° to the rolling direction, then polishing one side of the test piece with #600 sandpaper, and then giving a pre-strain of 20% to the test piece by performing a uniaxial tensile test in accordance with JIS Z 2241, when determining waviness height in the polished surface in the middle of the parallel part of the test piece in accordance with JIS B 0601-2001, maximum height waviness (ridging height) is 2.5 μm or less. The term "excellent in terms of surface roughening resistance" refers to a case where, when determining surface roughness in the polished surface in the middle of the parallel part of the test piece used for determining ridging resistance in accordance with JIS B 0601-2001, Ra is less than 0.2 μm.

In addition, the term "sufficient formability" refers to a case where, in a tensile test according to JIS Z 2241, a JIS No. 13B test piece taken in a direction perpendicular to the rolling direction exhibits an elongation after fracture (El) of 25% or more.

From the results of investigations conducted for solving the problems, the following were found: a stainless steel sheet is manufactured so as to have an appropriate composition and have a metallographic structure including a martensite phase having an area ratio of 5% to 50% and the balance being a ferrite phase, and is further controlled such that a ferrite phase in portions extending from the surface layers of the front and back surfaces of the steel sheet to, in the thickness direction of the sheet, positions at t/3 (t: thickness of the sheet), has an average grain diameter of 20 μm or more and 50 μm or less, and a ferrite phase in a central portion in the thickness direction of the sheet, the central portion being a portion of the sheet other than the portions extending from, in the thickness direction of the sheet, the surface layers to the positions at t/3 (t: thickness of the sheet), includes a ferrite phase satisfying an aspect ratio of more than 3.0. As a result, it is possible to obtain, after a cold rolling process and a cold-rolled-sheet annealing process, a ferritic stainless steel sheet which is excellent in terms of surface brightness, roping resistance, ridging resistance, and surface roughening resistance and which is excellent in terms of formability.

Aspects of the present invention have been completed on the basis of the findings described above, and the subject matter of aspects of the present invention is as follows.

[1] A material for a cold-rolled stainless steel sheet, the material having a chemical composition containing, by mass %, C: 0.005% to 0.05%, Si: 0.02% to 0.75%, Mn: 0.1% to 1.0%, P: 0.04% or less, S: 0.01% or less, Cr: 16.0% to 18.0%, Al: 0.001% to 0.10%, N: 0.005% to 0.06%, and the balance being Fe and inevitable impurities, and a metallographic structure including a martensite phase having an area ratio of 5% to 50% and the balance being a ferrite phase, wherein a ferrite phase in portions extending from surface layers of front and back surfaces of a steel sheet to, in a thickness direction of the sheet, positions at t/3 (t: thickness of the sheet), has an average grain diameter of 20 μm or more and 50 μm or less, and a ferrite phase in a central portion in the thickness direction of the sheet, the central portion being a portion of the sheet other than the portions extending from, in the thickness direction of the sheet, the surface layers to the positions at t/3 (t: thickness of the sheet), includes a ferrite phase satisfying an aspect ratio of more than 3.0.

[2] The material for a cold-rolled stainless steel sheet according to item [1] above, the chemical composition further containing, by mass %, one, two, or more selected from among Cu: 0.1% to 1.0%, Ni: 0.1% to 1.0%, Mo: 0.1% to 0.5%, and Co: 0.01% to 0.3%.

[3] The material for a cold-rolled stainless steel sheet according to item [1] or [2] above, the chemical composition further containing, by mass %, one, two, or more selected from among V: 0.01% to 0.25%, Ti: 0.001% to 0.015%, Nb: 0.001% to 0.030%, Mg: 0.0002% to 0.0050%, B: 0.0002% to 0.0050%, and REM: 0.01% to 0.10%.

Here, in the present description, % used when describing the chemical composition of steel shall always refer to mass %.

According to aspects of the present invention, it is possible to obtain a material for a cold-rolled stainless steel sheet, the material being suitable for manufacturing a cold-rolled stainless steel sheet which is excellent in terms of surface appearance quality before and after a forming process and which has sufficient formability. In other words, a cold-rolled ferritic stainless steel sheet manufactured from a material for a cold-rolled stainless steel sheet according to aspects of the present invention is excellent in terms of surface appearance quality.

DETAILED DESCRIPTION OF EMBODIMENTS OF THE INVENTION

Embodiments of the present invention will be described in detail hereafter.

A material for a cold-rolled stainless steel sheet according to aspects of the present invention has a chemical composition containing C: 0.005% to 0.05%, Si: 0.02% to 0.75%, Mn: 0.1% to 1.0%, P: 0.04% or less, S: 0.01% or less, Cr: 16.0% to 18.0%, Al: 0.001% to 0.10%, N: 0.005% to 0.06%, and the balance being Fe and inevitable impurities, and a metallographic structure including a martensite phase having an area ratio of 5% to 50% and the balance being a ferrite phase, wherein a ferrite phase in portions extending from surface layers of front and back surfaces of a steel sheet to, in a thickness direction of the sheet, positions at t/3 (t: thickness of the sheet), has an average grain diameter of 20 μm or more and 50 μm or less, and a ferrite phase in a central portion in the thickness direction of the sheet, the central portion being a portion of the sheet other than the portions extending from, in the thickness direction of the sheet, the surface layers to the positions at t/3 (t: thickness of the sheet), includes a ferrite phase satisfying an aspect ratio of more than 3.0. These are important requirements of aspects of the present invention. In particular, specifying the amount of martensite phase and specifying conditions of the ferrite phase (grain diameter and the presence or absence of unrecrystallized grains) are important requirements. When such a material is employed and subjected to standard processes including pickling (descaling), cold rolling, cold-rolled-sheet annealing, and further pickling and/or skin pass rolling as needed, it is possible to obtain a cold-rolled stainless steel sheet having sufficient formability, being excellent in terms of surface gloss, and having roping resistance, ridging resistance, and surface roughening resistance, in other words, being excellent in terms of surface appearance quality before and after a forming process.

The amount of martensite phase and the conditions of the ferrite phase can be controlled by appropriately controlling coiling temperature in a hot rolling process, and by further performing, before a cold rolling process, hot-rolled-sheet annealing for a short time in a dual-phase temperature range in which a ferrite phase and an austenite phase are formed. For example, when the steel sheet is coiled in a hot rolling process, the coiling temperature is set to 550° C. to 850° C. Furthermore, after the hot rolling process, hot-rolled-sheet annealing is performed so as to hold the steel sheet at a temperature of 890° C. to 950° C. for 15 seconds to 2 minutes.

When a martensite phase is formed by hot-rolled-sheet annealing, ferrite colonies (aggregates of ferrite grains having similar crystal orientations) are effectively destroyed. Thus, occurrence of ridging and roping, which are caused by an increase of deformation capability in a specific orientation due to formation of the colonies, is restrained. The martensite phase not only achieves destruction of ferrite colonies before the cold rolling process and in the cold rolling process; also, in the cold-rolled-sheet annealing process, prior-austenite grain boundaries and block boundaries, lath boundaries, and the like within the martensite phase serve as recrystallization sites of a ferrite phase, which provides an effect of further destroying the colonies.

Moreover, before the cold rolling process, a ferrite phase in portions extending from the surface layers of the front and back surfaces of the steel sheet to positions at t/3 (t: thickness of the sheet) is controlled to have an average grain diameter of 20 μm or more and 50 μm or less, so that the surface layer portions after the cold-rolled-sheet annealing process have a metallographic structure that is a ferrite single-phase structure having small grain diameters. This provides an effect of inhibiting, in a forming process, the occurrence of surface roughening caused by undulation of coarse crystal grains.

Of ferrite phases, the central portion in the thickness direction of the steel sheet, the central portion being a portion of the sheet other than the portions extending from the surface layers of the front and back surfaces of the steel sheet to the positions at t/3, includes a ferrite phase satisfying an aspect ratio of more than 3.0. Such a ferrite phase satisfying an aspect ratio of more than 3.0 is unrecrystallized. When the material to be cold-rolled includes the unrecrystallized ferrite phase, it has a relatively hard metallographic structure, hence it becomes a hard material. As a result, microscopic surface deformation in the cold rolling process is inhibited, so that the reduction of surface brightness caused by rolling-induced defects such as oil pits and scratched marks generated by the transfer of the polishing marks of rolls and roping caused by surface irregularities during application of tension are restricted.

Martensite Phase Having Area Ratio of 5% to 50%

In accordance with aspects of the present invention, the effect of destroying ferrite colonies is obtained by forming a martensite phase by hot-rolled-sheet annealing. Moreover, the presence of the martensite phase after the hot-rolled-sheet annealing process provides the effect of further destroying ferrite colonies in the cold rolling process and after the cold-rolled-sheet annealing process, which contributes to inhibition of ridging and roping. These effects are obtained when the martensite phase after the hot-rolled-sheet annealing process has an area ratio of 5% or more. However, when the martensite phase has an area ratio of more than 50%, the hot-rolled and annealed steel sheet is hardened. This results in, for example, an increase in the number of passes, edge cracks, and defect in shape in the cold rolling process, which is not preferred from the viewpoint of manufacturing. For this reason, the martensite phase after the hot-rolled-sheet annealing process is controlled to have an area ratio of 5% to 50%, preferably 10% to 40%.

In the steel composition according to aspects of the present invention, almost all the austenite phase formed at the hot-rolled-sheet annealing temperature is transformed into a martensite phase. For this reason, the area ratio of the austenite phase formed at the hot-rolled-sheet annealing temperature is nearly equal to the area ratio of the martensite phase after the hot-rolled-sheet annealing process. This area ratio of the austenite phase depends on the steel composition and the hot-rolled-sheet annealing temperature. C, N, Mn, Ni, and Cu cause an increase in the area ratio of the martensite phase, while Si and Cr cause a decrease. An increase in the annealing temperature causes an increase in the area ratio of the martensite phase, while a decrease in the annealing temperature causes a decrease. A desired area ratio of the martensite phase can be obtained by controlling the composition and the hot-rolled-sheet annealing temperature. Here, the remainder is a ferrite phase. The remainder may contain precipitates and inclusions. Examples of the precipitates and the inclusions are Cr carbonitride, V carbonitride, Ti carbonitride, Nb carbonitride, and alumina. The total area ratio (area %) of the precipitates and the inclusions is preferably less than 5%.

Ferrite phase in portions extending from steel sheet surface layers of front and back surfaces of steel sheet to, in thickness direction of sheet, positions at t/3, has average grain diameter of 20 μm or more and 50 μm or less Controlling the ferrite grain diameters of the surface layer portions is an important requirement for obtaining a desired surface appearance quality. Controlling grain diameters before the cold rolling process provides a metallographic structure composed of fine ferrite grains after the cold rolling process and the cold-rolled-sheet annealing process, which enhances the effect of destroying ferrite colonies and also contributes to inhibition of surface roughening.

Such effects are obtained when the material to be cold-rolled is controlled such that the ferrite phase has an average grain diameter of 50 μm or less. When the average grain diameter is more than 50 μm, in the final product sheet having been subjected to cold-rolled-sheet annealing, ferrite grains which are recrystallized by starting from sites of coarse ferrite grains existed before the cold rolling process become coarse grains. On the other hand, ferrite grains which are recrystallized by starting from the martensite phase become fine grains. As a result, the final product has a mixed-grain microstructure of ferrite grains having different grain diameters, so that surface roughening occurs in a forming work process. When the average grain diameter is less than 20 μm, the steel sheet is excessively hardened. As a result, an increase in the load of manufacturing occurs, such as an increase in the number of passes in the cold rolling process. In addition, recrystallization does not sufficiently occur by cold-rolled-sheet annealing, resulting in a deterioration in elongation. For these reasons, the grain diameters of a ferrite phase in portions extending from the surface layers of the steel sheet to positions at t/3 in the thickness direction of the sheet are controlled such that the average grain diameter is 20 μm or more and 50 μm or less. Here, the portions extending from the surface layers to positions at t/3 in the thickness direction of the sheet where the grain diameters of the ferrite phase are controlled, are a portion extending from the surface layer of the front surface of the steel sheet to the position at t/3 in the thickness direction of the sheet and a portion extending from the surface layer of the back surface of the steel sheet to the position at t/3 in the thickness direction of the sheet.

The remaining ferrite phase, which is in a central portion in the thickness direction of the steel sheet, the central portion being a portion of the sheet other than the portions extending from the steel sheet surface layers of the front and back surfaces of the steel sheet to the positions at t/3, includes a ferrite phase satisfying an aspect ratio of more than 3.0.

When the steel is provided by continuous casting, in the slab structure, the surface layer portions are composed of equiaxed grains, whereas the slab central portion is composed of considerably elongated grains due to a low cooling rate. When such a slab is hot-rolled, the ferrite phase in the surface layer portions is composed of finer equiaxed grains, because the ferrite phase present in the steel sheet surface layer portions in the hot rolling process is originally an equiaxed grains, and accumulation of strain caused by rolling and relax of the strain due to recrystallization are repeated during the hot rolling process. However, in the central portion in the thickness direction of the sheet elongated grains generated by casting remain, because an amount of strain introduced by rolling is small in the central portion in the thickness direction of the sheet, so that recrystallization, which is caused by accumulation of a large amount of strain, is less likely to occur. In addition, although recovery occurs in the hot rolling process, since recrystallization does not occur, work strain introduced by rolling is not completely removed. Thus, the density of dislocations is relatively high, compared with ferrite grains generated by recrystallization. In particular, a ferrite phase satisfying an aspect ratio of 3.0 or more (unrecrystallized ferrite phase) is harder than equiaxial ferrite grains in the surface layer portions.

It is important in accordance with aspects of the present invention to avoid excessive softening of the material to be cold-rolled by leaving such a ferrite phase satisfying an aspect ratio of more than 3.0 is left in the central portion in the thickness direction of the sheet.

Here, the aspect ratio in accordance with aspects of the present invention is determined by the following formula (1).

$$r_\alpha \text{ (aspect ratio)} = d_r \text{ (crystal grain diameter in the rolling direction)} / d_t \text{ (crystal grain diameter in the thickness direction of the sheet)} \quad (1)$$

A hardness necessary and sufficient for decreasing the surface deformation capability without affecting the number of passes of cold rolling is obtained by including the ferrite phase satisfying an aspect ratio of more than 3.0. Moreover, since the central portion in the thickness direction of the sheet is harder than the surface layers, deformation that occurs in the thickness direction of the sheet and in the width direction of the sheet under application of rolling tension is inhibited. Conventionally the entire portion in the thickness direction of the sheet is recrystallized and has a high deformation capability. Therefore, when rolling tension is applied, deformation in the thickness direction of the sheet and that in the width direction of the sheet vary in the width direction of the sheet, which results in occurrence of surface irregularities and unevenness. However, in accordance with aspects of the present invention, since deformation of the central portion in the thickness direction of the sheet is inhibited, even if deformation occurs in the recrystallized portions of the surface layers, it is constrained by the central portion. As a result, even when deformation varies in the width direction of the sheet, irregularities through the whole thickness of the sheet are less likely to be formed, which also provides an effect of reducing roping. When recrystallization is sufficiently caused to progress to the central portion in the thickness direction of the sheet, softening occurs. Thus, the surfaces have an increased deformation capability, which is likely to result in occurrence of large rolling-induced surface defects such as oil pits particularly at the initial stage of rolling. Here, oil pits are fine dent flaws which are caused by lubricant used in a rolling process, drawn into roll-bite, and enclosed in the surfaces of the steel sheet.

The ratio of the ferrite phase satisfying an aspect ratio of more than 3.0 to the ferrite phase is preferably, in an area ratio, 10% or more. The remaining ferrite phase of the central portion in the thickness direction of the sheet, the central portion being a portion of the sheet other than the portions extending from the sheet surface layers to the positions at t/3, may all be an unrecrystallized ferrite phase. More preferably, the ratio is, in an area ratio, 20% or more.

Hereafter, the chemical composition of a material for a cold-rolled stainless steel sheet according to aspects of the present invention will be described. Hereinafter, % refers to mass %, unless otherwise noted.

C: 0.005% to 0.05%

C provides an effect of promoting the formation of an austenite phase and expanding a dual-phase temperature range in which a ferrite phase and an austenite phase are formed in a hot-rolled-sheet annealing process. In addition, C provides an effect of inhibiting an increase in grain diameter. In order to obtain these effects, it is necessary that the C content be 0.005% or more. In addition, in the case where the C content is less than 0.005%, the amount of martensite formed is below the range according to aspects of the present invention, so that the specified brightness, roping resistance, ridging resistance, and surface roughening resistance cannot be achieved. However, in the case where the C content is more than 0.05%, there is a deterioration in ductility due to an increase in the hardness of a steel sheet. In addition, the amount of martensite formed is beyond the range according to aspects of the present invention, so that the specified formability cannot be achieved. In addition, an excessive amount of martensite is formed in a hot-rolled-sheet annealing process, so that there is a deterioration in manufacturability due to an increase in rolling load in a cold rolling process, Therefore, the C content is set to be 0.005% to 0.05%, preferably 0.01% to 0.03%, or more preferably 0.01% to 0.02%. The term "C content" refers to the amount of C contained, and the same goes for other constituent chemical elements.

Si: 0.02% to 0.75%

Si is a chemical element which functions as a deoxidizing agent in the process of preparing molten steel. In order to obtain such an effect, it is necessary that the Si content be 0.02% or more. However, in the case where the Si content is more than 0.75%, since there is an increase in the hardness of a steel sheet, there is an increase in rolling load in a hot rolling process and a deterioration in ductility after a finish annealing process.

Therefore, the Si content is set to be 0.02% to 0.75%, preferably 0.10% to 0.50%, or more preferably 0.15% to 0.35%.

Mn: 0.1% to 1.0%

Mn provides, like C, an effect of promoting the formation of an austenite phase and expanding a dual-phase temperature range in which a ferrite phase and an austenite phase are formed in a hot-rolled-sheet annealing process. In order to obtain this effect, it is necessary that the Mn content be 0.1% or more. However, in the case where the Mn content is more than 1.0%, there is a deterioration in corrosion resistance due to an increase in the amount of MnS formed. Therefore, the Mn content is set to be 0.1% to 1.0%, preferably 0.55% to 0.90%, or more preferably 0.65% to 0.85%.

P: 0.04% or Less

Since P is a chemical element which promotes intergranular fracturing due to intergranular segregation, it is desirable that the P content be low, and the upper limit of the P content is set to be 0.04%, or preferably 0.03% or less.

S: 0.01% or Less

S is a chemical element which deteriorates, for example, ductility and corrosion resistance as a result of existing in the form of sulfide-based inclusions such as MnS, and such negative harmful effects become marked, in particular, in the case where the S content is more than 0.01%. Therefore, it is desirable that the S content be as low as possible, and the upper limit of the S content is set to be 0.01%, preferably 0.007% or less, or more preferably 0.005% or less, in accordance with aspects of the present invention.

Cr: 16.0% to 18.0%

Cr is a chemical element which provides an effect of improving corrosion resistance by forming a passivation film on the surface of a steel sheet. This effect is obtained when the Cr content is 16.0% or more; and the higher the Cr content, the higher the corrosion resistance. In addition, Cr provides an effect of inhibiting formation of an austenite phase in a hot-rolled-sheet annealing process. In the case where the Cr content is less than 16.0%, an excessively large amount of austenite phase is formed in a hot-rolled-sheet annealing process, so that the area ratio of the martensite phase cannot become 50% or less, which is specified in accordance with aspects of the present invention. Thus, the amount of martensite formed is beyond the range according to aspects of the present invention, so that the specified formability cannot be achieved. For this reason, the Cr content is set to be 16.0% or more. On the other hand, in the case where the Cr content is more than 18.0%, formation of an austenite phase in a hot-rolled-sheet annealing process is insufficient, so that the area ratio of the martensite phase cannot become 5% or more, which is specified. Thus, the amount of martensite formed is below the range according to aspects of the present invention, so that the specified ridging resistance cannot be achieved. Therefore, the Cr content is set to be 18.0% or less, preferably 16.0% to 17.5%, or more preferably 16.5% to 17.0%.

Al: 0.001% to 0.10%

Al is, like Si, a chemical element which functions as a deoxidizing agent. In order to obtain such an effect, it is necessary that the Al content be 0.001% or more. However, in the case where the Al content is more than 0.10%, since there is an increase in the amount of Al-based inclusions such as $Al_2O_3$, there is a tendency for surface quality to be deteriorated. Therefore, the Al content is set to be 0.001% to 0.10%, preferably 0.001% to 0.07%, or more preferably 0.001% to 0.01%.

N: 0.005% to 0.06%

N provides, like C and Mn, an effect of promoting the formation of an austenite phase and expanding a dual-phase temperature range in which a ferrite phase and an austenite phase are formed in a hot-rolled-sheet annealing process. In order to obtain this effect, it is necessary that the N content be 0.005% or more. However, in the case where the N content is more than 0.06%, there is a significant deterioration in ductility, and there is a deterioration in corrosion resistance as a result of promoting the precipitation of Cr nitrides. Therefore, the N content is set to be 0.005% to 0.06%, preferably 0.01% to 0.03%, or more preferably 0.01% to 0.02%.

The remainder is Fe and inevitable impurities.

With the chemical composition described above, the effects of aspects of the present invention are provided. Moreover, the following chemical elements may be contained in order to improve manufacturability or material properties.

One, two, or more selected from among Cu: 0.1% to 1.0%, Ni: 0.1% to 1.0%, Mo: 0.1% to 0.5%, and Co: 0.01% to 0.3%

Cu and Ni are both chemical elements which improve corrosion resistance. Containing Cu and/or Ni is effective, in particular, in the case where high corrosion resistance is required. In addition, Cu and Ni provide an effect of promoting the formation of an austenite phase and expanding a dual-phase temperature range in which a ferrite phase and an austenite phase are formed in a hot-rolled-sheet annealing process. Such effects become marked in the case where the content of each of these chemical elements is 0.1% or more. However, it is not preferable that the Cu content be more than 1.0%, because there may be a deterioration in hot workability. Therefore, in the case where Cu is contained, the Cu content is set to be 0.1% to 1.0%, preferably 0.2% to 0.8%, or more preferably 0.3% to 0.5%. It is not preferable that the Ni content be more than 1.0%, because there may be a deterioration in workability. Therefore, in the case where Ni is contained, the Ni content is set to be 0.1% to 1.0%, preferably 0.1% to 0.6%, or more preferably 0.1% to 0.3%.

Mo is a chemical element which improves corrosion resistance. Containing Mo is effective, in particular, in the case where high corrosion resistance is required. Such an effect becomes marked in the case where the Mo content is 0.1% or more. However, it is not preferable that the Mo content be more than 0.5%, because, since there is an insufficient amount of austenite phase formed in a hot-rolled-sheet annealing process, there is a case where it is not possible to achieve the specified surface appearance quality. Therefore, in the case where Mo is contained, the Mo content is set to be 0.1% to 0.5%, preferably 0.2% to 0.4%.

Co is a chemical element which improves toughness. Such an effect is obtained in the case where the Co content is 0.01% or more. On the other hand, in the case where the Co content is more than 0.3%, there may be a deterioration in manufacturability. Therefore, in the case where Co is added, the Co content is set to be 0.01% to 0.3%.

One, two, or more selected from among V: 0.01% to 0.25%, Ti: 0.001% to 0.015%, Nb: 0.001% to 0.030%, Mg: 0.0002% to 0.0050%, B: 0.0002% to 0.0050%, and REM: 0.01% to 0.10%

V: 0.01% to 0.25%, Ti: 0.001% to 0.015%, and Nb: 0.001% to 0.030%

V, Ti, and Nb, which are chemical elements having a high affinity for C and N, provide effects of improving workability after a finish annealing process by decreasing the amounts of a solid solute C and a solid solute N in a parent phase as a result of being precipitated in the form of carbides and nitrides in a hot rolling process. In order to obtain these effects, it is necessary that the V content be 0.01% or more, or that the Ti content be 0.001% or more, or that the Nb content be 0.001% or more. However, in the case where the V content is more than 0.25%, there may be a deterioration in workability. In the case where the Ti content is more than 0.015% or where the Nb content is more than 0.030%, there is a case where it is not possible to achieve good surface quality due to an excessive amount of TiN or NbC precipitated. Therefore, in the case where V is contained, the V content is set to be 0.01% to 0.25%; in the case where Ti is contained, the Ti content is set to be 0.001% to 0.015%; and in the case where Nb is contained, the Nb content is set to be 0.001% to 0.030%. V content is preferably 0.02% to 0.20%, more preferably 0.03% to 10%. Ti content is preferably 0.003% to 0.010%. Nb content is preferably 0.002% to 0.020%, more preferably 0.003% to 0.015%.

Mg: 0.0002% to 0.0050%

Mg is a chemical element which has the effect of improving hot workability. In order to obtain this effect, it is necessary that the Mg content be 0.0002% or more. However, in the case where the Mg content is more than 0.0050%, there may be a deterioration in surface quality. Therefore, in the case where Mg is contained, the Mg content is set to be 0.0002% to 0.0050%, preferably 0.0005% to 0.0030%, or more preferably 0.0005% to 0.0010%.

B: 0.0002% to 0.0050%

B is a chemical element which is effective for preventing secondary cold work embrittlement. In order to obtain such an effect, it is necessary that the B content be 0.0002% or more. However, in the case where the B content is more than 0.0050%, there may be a deterioration in hot workability. Therefore, in the case where B is contained, the B content is set to be 0.0002% to 0.0050%, preferably 0.0005% to 0.0030%, more preferably 0.0005% to 0.0010%.

REM: 0.01% to 0.10%

REM is a chemical element which improves oxidation resistance and which provides, in particular, an effect of improving the corrosion resistance of a weld zone by inhibiting the formation of an oxide film in the weld zone. In order to obtain this effect, it is necessary that the REM content be 0.01% or more. However, in the case where the REM content is more than 0.10%, there may be a deterioration in manufacturability, for example, a deterioration in pickling performance in a cold-rolled-sheet annealing process. In addition, since REM is an expensive chemical element, it is not preferable that the REM content be excessively high, because there is an increase in manufacturing costs. Therefore, in the case where REM is contained, the REM content is set to be 0.01% to 0.10%.

Hereafter, an example of a method for manufacturing a material for a cold-rolled stainless steel sheet according to aspects of the present invention will be described.

By preparing molten steel having the chemical composition described above by using a known method such as one using a converter, an electric furnace, or a vacuum melting furnace, and by then using a continuous casting method or an ingot casting-slabbing method, a steel material (slab) is obtained. By performing hot rolling on the slab after having heated the slab to a temperature of 1100° C. to 1250° C., or by performing hot rolling on the slab as cast without heating, a hot-rolled steel sheet is obtained. In the hot rolling process, finish rolling is completed in the range of 900° C. to 1100° C.; subsequently, when the steel sheet is coiled, the coiling temperature is set to 550° C. to 850° C. More preferably, the coiling temperature is 600° C. to 700° C. In the case where the coiling temperature is less than 550° C., the austenite phase present in the hot rolling process is, substantially without being decomposed into a ferrite phase and carbonitride, cooled and transformed into martensite. Thus, the martensite phase ratio is beyond the range according to aspects of the present invention, and the average grain diameter of the ferrite phase of the surface layer portions is below the range according to aspects of the present invention. Therefore, the specified formability and surface roughening resistance cannot be achieved. In the case where the coiling temperature is more than 850° C., regardless of the amount of strain, recrystallization occurs and the amount of unrecrystallized ferrite phase in the central portion is considerably decreased, so that the specified glossiness cannot be achieved. Therefore, the coiling temperature is set to be 550° C. to 850° C. With this, it is possible to facilitate the control of grain diameter and recrystallization of a ferrite phase in a continuous hot-rolled-sheet annealing process which is completed in a short time.

Subsequently, the hot-rolled steel sheet is subjected to hot-rolled-sheet annealing in which the steel sheet is held at a temperature of 890° C. to 1050° C., that is, in a dual-phase temperature range in which a ferrite phase and an austenite phase are formed, for 10 seconds to 2 minutes. Here, in the case where the hot-rolled-sheet annealing temperature is less than 890° C., the annealing is performed in the ferrite single-phase range, resulting in that the amount of martensite formed is below the range according to aspects of the present invention. Thus, the effect of inhibiting occurrence of ridging and roping, the effect being provided by formation of a martensite phase, cannot be provided. In addition, since recrystallization progresses to the central portion in the thickness direction of the sheet, the grain size increases excessively. This results in a soft material in which, for example, rolling-induced defects are likely to occur in a cold rolling process and there is a deterioration in brightness. Thus, the effects of aspects of the present invention are not provided.

On the other hand, in the case where the annealing temperature is more than 1050° C., the concentration of C in the austenite phase is promoted by progressing dissolution of carbides in solid, so that a large amount of excessively hard martensite phase is formed, resulting in a deterioration in elongation after the cold-rolled-sheet annealing process. In addition, the amount of martensite formed is beyond the range according to aspects of the present invention, so that the specified formability cannot be achieved. Moreover, an increase in the size of ferrite grains is promoted and this is a cause of increasing the degree of surface roughening, which is not preferred. In the case where the annealing time is less than 10 seconds, annealing at the specified temperature affects only the uppermost surfaces and recrystallization of the ferrite phase does not sufficiently progress in the thickness direction of the sheet. This results in a hard material to be cold-rolled, which increases the load of cold rolling. In addition, the average grain diameter of the ferrite phase of the surface layer portions is below the range according to aspects of the present invention, so that the specified formability cannot be achieved. On the other hand, in the case where the annealing time is more than 2 minutes, transformation into an austenite phase excessively progresses, so that the amount of martensite after cooling is more than a desired amount. In addition, the surface layer portions in the thickness direction of the sheet are composed of excessively coarse ferrite grains. Thus, the average grain diameter of the ferrite phase of the surface layer portions is beyond the range according to aspects of the present invention, so that the specified brightness and surface roughening resistance cannot be achieved. In some cases, recrystallization progresses to the center in the thickness direction of the sheet to cause softening. Thus, the variation in hardness between the ferrite phase region and the martensite phase region causes fluctuations in the thickness of the sheet and fluctuations in the load in the cold rolling process, which causes a deterioration in the manufacturing capability. After the cold-rolled-sheet annealing process, a mixed-grain microstructure or a coarse ferrite single-phase structure is formed, resulting in a deterioration in surface roughening resistance. After the hot-rolled-sheet annealing process, pickling is performed as needed.

As a result, a material for a cold-rolled stainless steel sheet according to aspects of the present invention is manufactured.

Here, in the case where a cold-rolled ferritic stainless steel sheet is manufactured from the above-described material for a cold-rolled stainless steel sheet, it can be manufactured by the following method, for example.

The material for a cold-rolled steel sheet is subjected to cold rolling and cold-rolled-sheet annealing (finish annealing).

The cold rolling may be performed with any one of a tandem mill and a cluster mill. The cold rolling is desirably performed at a rolling reduction of 50% or more from the viewpoint of formability and shape correction; however, this is not a limitation.

The cold-rolled-sheet annealing should be performed in a temperature range in which a ferrite single-phase is formed. In order to achieve high elongation, the annealing temperature range is set to 800° C. to 890° C., more preferably 850° C. to 890° C. In the case where the temperature range is less than 800° C., a martensite phase may remain and a deterioration in elongation may occur. In the case where the temperature is higher than 890° C., an austenite phase is newly formed and a martensite phase is formed in a cooling process, resulting in a significant deterioration in formability. In addition, from the viewpoint of manufacturability and avoidance of excessive grain growth of recrystallized ferrite grains, the cold-rolled-sheet annealing is desirably performed by a continuous annealing process, preferably a continuous annealing process of holding the cold-rolled sheet in a temperature range of 800° C. to 890° C. for 5 to 120 seconds. Moreover, in order to achieve sufficient formability and to prevent occurrence of surface roughening after working, the continuous annealing process is more preferably performed by holding the cold-rolled sheet for 10 to 60 seconds.

There is no particular limitation on surface finish, and appropriate surface finish may be selected from among, for example, No. 2B, BA, polishing, and dull finish. In order to provide desired surface roughness and in order to prevent stretcher strain, skin pass rolling should be performed with an elongation ratio of 0.3% to 1.0%.

EXAMPLE 1

Hereafter, aspects of the present invention will be described in more detail on the basis of examples.

The stainless steels having the chemical compositions given in Table 1 were made into slabs having a thickness of 200 mm by using a continuous casting method. After having heated these slabs to a temperature of 1180° C., the slabs were subjected to hot rolling in which hot-rolled sheets were coiled at the temperatures given in Table 2, to thereby provide hot-rolled sheets having a thickness of 4 mm.

Subsequently, after having performed hot-rolled-sheet annealing on the hot-rolled sheets described above under the conditions given in Table 2, a shot blasting treatment was performed on the surfaces of the annealed sheets, and descaling was performed by performing pickling with two kinds of solutions, that is, sulfuric acid and a mixed acid composed of nitric acid and hydrofluoric acid. Thus, hot-rolled and annealed steel sheets (materials for cold-rolled stainless steel sheets) were manufactured.

The hot-rolled and annealed steel sheets (materials for cold-rolled stainless steel sheets) were subjected to measurements in terms of the area ratio of the metallographic structure, ferrite grain diameter, and the ratio of an unrecrystallized ferrite phase by using the following methods.

Metallographic Structures of Hot-Rolled and Annealed Steel Sheets (Materials for Cold-Rolled Stainless Steel Sheets)

In each of the obtained hot-rolled and annealed steel sheets, after having taken a test piece for microstructure observation from the central portion in the width direction of the steel sheet, having performed mirror polishing on the cross section in the rolling direction, and having etched the cross section with aqua regia, photographs were taken in 9 fields of view from a surface to the center in the thickness direction of the steel sheet by using an optical microscope at a magnification of 400 times. The positions where the photographs were taken were, from one of the surface layers in the thickness direction of the sheet, at 1t/18, 3t/18, 5t/18, 7t/18, 9t/18, 11t/18, 13t/18, 15t/18, and 17t/18 (t: thickness of the sheet). In the microstructure photographs taken, from the viewpoint of metallographic properties, in particular, an etched phase appearing black was identified as a martensite phase, and the other phase was separately identified as a ferrite phase. Each field of view was subjected to image analysis to measure the area ratio of the martensite phase. And the average value of the area ratios in the 9 fields of view was determined as the area ratio of the martensite phase.

Regarding the images photographed at 1t/18, 3t/18, 5t/18, 13t/18, 15t/18, and 17t/18 (t: thickness of the sheet) from a surface layer of the steel sheet in the thickness direction of the sheet, which were photographed at such positions corresponding to portions extending from the surface layers to positions at t/3 (t: thickness of the sheet) in the thickness direction of the sheet, ferrite grain diameters were measured in accordance with JIS G 0551. The average value of the diameters in the 6 fields of view was determined as the average grain diameter of the portions extending from the surface layers to the positions at t/3 (t: thickness of the sheet) in the thickness direction of the sheet. Regarding the images at 7t/18, 9t/18, and 11t/18 (t: thickness of the sheet) from a surface layer in the thickness direction of the sheet, which correspond to the central portion in the thickness direction of the sheet, the central portion being a portion of the sheet other than the portions extending from the sheet surface layers to the positions at t/3, ferrite grains were measured in terms of aspect ratio represented by the formula (1). The area ratios of grains satisfying an aspect ratio of more than 3.0 were determined. The average of the area ratios in the 3 fields of view was determined as the ratio of the unrecrystallized ferrite phase in the central portion in the thickness direction of the sheet, the central portion being a portion of the sheet other than the portions extending from the sheet surface layers to the positions at t/3.

In addition, cold-rolled stainless steel sheets were manufactured from the materials for cold-rolled stainless steel sheets by using the following method, and the properties of the cold-rolled stainless steel sheets were evaluated.

The hot-rolled and annealed steel sheets obtained above were cold-rolled to a thickness of 0.8 mm, and subjected to cold-rolled-sheet annealing under the conditions given in Table 2. After that, a descaling treatment was performed by electrolytic pickling. Finally, skin pass rolling was performed with an elongation ratio of 0.3% to 1.0%.

Evaluations of Properties of Cold-Rolled Stainless Steel Sheets (1) Formability

A JIS No. 13B tensile test piece was taken, from the central portion in the width direction of a steel sheet, in a direction at an angle of 90° to the rolling direction. A tensile test was performed in accordance with JISZ 2241. A case where the elongation after fracture (El) was 25% or more was judged as satisfactory (○), and a case where the elongation after fracture (El) was less than 25% was judged as unsatisfactory (×). In addition, a case where the elongation after fracture (El) was 30% or more was judged as more than satisfactory (⊙).

(2) Surface Appearance Quality (2-1) Surface Brightness

A test piece was taken from the central portion in the width direction of the steel sheet, and then brightness was determined at two points each in directions at angles of 0° and 90° to the rolling direction by using the reflected energy (Gs20°) of a light having an incidence angle of 20° in accordance with the prescription in JIS Z 8741. Then, on the basis of the average value of the determined values, a case where the brightness was 950 or more was judged as a case of excellent brightness (○) and a case where the brightness was less than 950 was judged as unsatisfactory (×). In addition, a case where the brightness was more than 1000 was judged as more than excellent (⊙).

(2-2) Roping Resistance

A test piece was taken from the central portion in the width direction of the steel sheet, and then surface roughness in a direction at an angle of 90° to the rolling direction was determined in accordance with JIS B 0601-2001. A case where Rz was 0.2 μm or less was judged as satisfactory (○) and a case where Rz was more than 0.2 μm was judged as unsatisfactory (×).

(2-3) Ridging Resistance

A JIS No. 5 test piece was taken, from the central portion in the width direction of the steel sheet, in a direction at an angle of 0° to the rolling direction; then one side of the test piece was polished to #600 finish, and a pre-strain of 20% was given to the test piece by applying a uniaxial tensile stress in accordance with JIS Z 2241. Then waviness height in the polished surface in the middle of the parallel part of the test piece was determined in accordance with JIS B 0601-2001. A case where the waviness height was 2.5 μm or less was judged as satisfactory (○) and a case where the waviness height was not 2.5 μm or less was judged as unsatisfactory (×). In addition, a case where the waviness height was less than 2.0 μm was judged as more than excellent (⊙).

(2-4) Surface Roughening Resistance

The test piece having been used for determining ridging resistance was used. Surface roughness in the polished surface in the middle of the parallel part of the test piece was determined in accordance with JIS B 0601-2001. A case where Ra was less than 0.2 μm was judged as satisfactory (○) and a case where Ra was not less than 0.2 μm was judged as unsatisfactory (×).

The results of the evaluations described above are given along with the manufacturing conditions in Table 2.

TABLE 1

| | mass % | | | | | | | | | | |
|---|---|---|---|---|---|---|---|---|---|---|---|
| Steel Code | C | Si | Mn | P | S | Cr | Al | N | Ni | Others | Note |
| A | 0.02 | 0.17 | 0.44 | 0.02 | 0.005 | 16.7 | 0.028 | 0.04 | — | — | Example |
| B | 0.03 | 0.23 | 0.51 | 0.02 | 0.002 | 16.3 | 0.002 | 0.03 | 0.2 | — | Example |
| C | 0.03 | 0.27 | 0.60 | 0.04 | 0.006 | 16.3 | 0.004 | 0.05 | 0.1 | V: 0.04 | Example |
| D | 0.03 | 0.21 | 0.57 | 0.03 | 0.002 | 16.7 | 0.003 | 0.04 | 0.1 | — | Example |
| E | 0.03 | 0.19 | 0.57 | 0.02 | 0.003 | 16.4 | 0.011 | 0.06 | 0.2 | Cu: 0.2, Mo: 0.2 | Example |
| F | 0.04 | 0.23 | 0.72 | 0.02 | 0.004 | 17.6 | 0.078 | 0.03 | 0.1 | Ti: 0.014, Nb: 0.021 | Example |
| G | 0.04 | 0.26 | 0.77 | 0.04 | 0.005 | 16.0 | 0.015 | 0.02 | — | Co: 0.13, B: 0.0018 | Example |
| H | 0.04 | 0.15 | 0.74 | 0.02 | 0.003 | 16.1 | 0.004 | 0.02 | 0.5 | Mg: 0.0013, REM: 0.04 | Example |
| I | 0.04 | 0.22 | 0.82 | 0.03 | 0.003 | 15.8 | 0.045 | 0.03 | — | — | Comparative Example |
| J | 0.03 | 0.26 | 0.71 | 0.03 | 0.003 | 18.3 | 0.033 | 0.04 | 0.2 | — | Comparative Example |
| K | 0.07 | 0.36 | 0.69 | 0.03 | 0.006 | 16.6 | 0.048 | 0.05 | — | — | Comparative Example |
| L | 0.004 | 0.27 | 0.85 | 0.04 | 0.005 | 16.2 | 0.021 | 0.06 | 0.3 | — | Comparative Example |
| M | 0.005 | 0.17 | 0.81 | 0.03 | 0.002 | 16.4 | 0.004 | 0.017 | 0.1 | — | Example |
| N | 0.016 | 0.20 | 0.77 | 0.04 | 0.004 | 16.6 | 0.003 | 0.012 | 0.3 | Ti: 0.009, Nb: 0.014 | Example |
| O | 0.011 | 0.13 | 0.84 | 0.04 | 0.003 | 16.5 | 0.004 | 0.006 | 0.2 | — | Example |

TABLE 2

| | | Hot Rolling Coiling | Hot-rolled-sheet Annealing | | Martensite | Ferrite Phase Average Grain Diameter in | Unrecrystallized Ferrite Phase | Cold-rolled-sheet Annealing |
|---|---|---|---|---|---|---|---|---|
| No. | Steel Code | Temperature (° C.) | Temperature (° C.) | Time (s) | Phase Area Ratio (%) | Surface Layer Portions (μm) | Ratio in Central Portion (%) | Temperature (° C.) |
| 1 | A | 689 | 910 | 15 | 31 | 48 | 60 | 889 |
| 2 | B | 635 | 926 | 21 | 36 | 45 | 72 | 871 |
| 3 | B | 581 | 945 | 36 | 48 | 39 | 85 | 889 |
| 4 | B | 716 | 891 | 79 | 18 | 48 | 36 | 860 |
| 5 | B | 820 | 946 | 42 | 12 | 50 | 28 | 840 |
| 6 | B | 554 | 915 | 19 | 42 | 21 | 89 | 838 |
| 7 | C | 662 | 920 | 23 | 28 | 36 | 78 | 869 |
| 8 | C | 580 | 942 | 11 | 41 | 28 | 100 | 856 |

TABLE 2-continued

| | | | | | | | | |
|---|---|---|---|---|---|---|---|---|
| 9 | C | 845 | 895 | 82 | 15 | 49 | 11 | 842 |
| 10 | D | 645 | 931 | 19 | 43 | 43 | 68 | 853 |
| 11 | E | 680 | 919 | 34 | 38 | 41 | 57 | 881 |
| 12 | F | 623 | 925 | 26 | 32 | 29 | 89 | 879 |
| 13 | G | 650 | 932 | 14 | 27 | 33 | 75 | 880 |
| 14 | H | 662 | 917 | 15 | 26 | 42 | 79 | 879 |
| 15 | I | 654 | 910 | 16 | 55 | 37 | 81 | 883 |
| 16 | J | 653 | 925 | 15 | 3 | 49 | 78 | 881 |
| 17 | K | 680 | 923 | 27 | 57 | 22 | 87 | 867 |
| 18 | L | 620 | 936 | 31 | 7 | 48 | 35 | 890 |
| 19 | A | 525 | 916 | 17 | 55 | 18 | 97 | 888 |
| 20 | B | 870 | 918 | 17 | 32 | 47 | 0 | 861 |
| 21 | B | 502 | 928 | 31 | 58 | 15 | 100 | 853 |
| 22 | B | 620 | 986 | 21 | 53 | 48 | 85 | 888 |
| 23 | B | 620 | 941 | 231 | 28 | 57 | 21 | 846 |
| 24 | C | 580 | 928 | 1 | 14 | 16 | 100 | 860 |
| 25 | C | 680 | 840 | 24 | 0 | 48 | 24 | 860 |
| 26 | M | 666 | 988 | 51 | 11 | 34 | 87 | 841 |
| 27 | N | 691 | 1001 | 53 | 16 | 28 | 76 | 843 |
| 28 | O | 643 | 993 | 51 | 13 | 37 | 83 | 841 |

| No. | Cold-rolled-sheet Annealing Time (s) | Formability Elongation After Fracture | Brightness | Roping Resistance | Ridging Resistance | Surface Roughening Resistance | Note |
|---|---|---|---|---|---|---|---|
| 1 | 23 | ○ | ⊙ | ○ | ⊙ | ○ | Example |
| 2 | 25 | ○ | ⊙ | ○ | ⊙ | ○ | Example |
| 3 | 18 | ○ | ⊙ | ○ | ⊙ | ○ | Example |
| 4 | 26 | ○ | ○ | ○ | ○ | ○ | Example |
| 5 | 29 | ○ | ⊙ | ○ | ○ | ○ | Example |
| 6 | 32 | ○ | ⊙ | ○ | ⊙ | ○ | Example |
| 7 | 29 | ○ | ⊙ | ○ | ⊙ | ○ | Example |
| 8 | 42 | ○ | ⊙ | ○ | ○ | ○ | Example |
| 9 | 28 | ○ | ⊙ | ○ | ○ | ○ | Example |
| 10 | 25 | ○ | ⊙ | ○ | ⊙ | ○ | Example |
| 11 | 31 | ○ | ⊙ | ○ | ⊙ | ○ | Example |
| 12 | 34 | ○ | ⊙ | ○ | ⊙ | ○ | Example |
| 13 | 28 | ○ | ⊙ | ○ | ⊙ | ○ | Example |
| 14 | 21 | ○ | ⊙ | ○ | ⊙ | ○ | Example |
| 15 | 17 | x | ○ | ○ | ○ | ○ | Comparative Example |
| 16 | 23 | ○ | ○ | ○ | x | ○ | Comparative Example |
| 17 | 31 | x | ○ | ○ | ○ | ○ | Comparative Example |
| 18 | 26 | ○ | x | x | ○ | x | Comparative Example |
| 19 | 25 | x | ○ | ○ | ○ | x | Comparative Example |
| 20 | 17 | ○ | x | ○ | ○ | ○ | Comparative Example |
| 21 | 12 | x | ○ | ○ | ○ | x | Comparative Example |
| 22 | 15 | x | ○ | ○ | ○ | ○ | Comparative Example |
| 23 | 31 | ○ | x | ○ | ○ | x | Comparative Example |
| 24 | 30 | x | ○ | ○ | ○ | ○ | Comparative Example |
| 25 | 30 | ○ | x | x | x | ○ | Comparative Example |
| 26 | 31 | ⊙ | ⊙ | ○ | ○ | ○ | Example |
| 27 | 31 | ⊙ | ⊙ | ○ | ○ | ○ | Example |
| 28 | 30 | ⊙ | ⊙ | ○ | ○ | ○ | Example |

From Tables, it is clarified that, in Examples according to aspects of the present invention, it is possible to achieve sufficient formability (elongation after fracture) and excellent surface appearance quality.

In the case of No. 15 where the Cr content was below the range according to aspects of the present invention and in the case of No. 17 where the C content was beyond the range according to aspects of the present invention, the amount of martensite formed was beyond the range according to aspects of the present invention and it was not possible to achieve the specified formability.

In the case of No. 16 where the Cr content was beyond the range according to aspects of the present invention, the amount of martensite formed was below the range according to aspects of the present invention, and it was not possible to achieve the specified ridging resistance. In the case of No. 18 where the C content was below the range according to aspects of the present invention, the amount of martensite formed was below the range according to aspects of the present invention and it was not possible to achieve the specified brightness, roping resistance, ridging resistance, and surface roughening resistance.

In the cases of Nos. 19 and 21 where the coiling temperatures were excessively low, the martensite phase ratio was beyond the range according to aspects of the present invention and the average grain diameter of the ferrite phase of the surface layer portions was below the range according to aspects of the present invention, and it was not possible to achieve the specified formability and surface roughening resistance. In the case of No. 20 where the coiling temperature was excessively high, no unrecrystallized ferrite phase was present in the central portion, and it was not possible to achieve the specified brightness. In the case of No. 22 where the hot-rolled-sheet annealing temperature was excessively high, the amount of martensite formed was beyond the range according to aspects of the present invention and it was not possible to achieve the specified formability. In the case of No. 23 where the hot-rolled-sheet annealing time was excessively long, the average grain diameter of the ferrite phase of the surface layer portions was beyond the range according to aspects of the present invention, and it was not possible to achieve the specified brightness and surface roughening resistance. In the case of No. 24 where the hot-rolled-sheet annealing time was excessively short, the average grain diameter of the ferrite phase of the surface layer portions was below the range according to aspects of the present invention, and it was not possible to achieve the specified formability. In the case of No. 25 where the hot-rolled-sheet annealing temperature was excessively low, the amount of martensite formed was below the range according to aspects of the present invention, and it was not possible to achieve the specified brightness, roping resistance, and ridging resistance.

In summary, it is clarified that, by using a material for a cold-rolled stainless steel sheet according to aspects of the present invention in which the amount of martensite and the average grain diameter and the degree of recrystallization of a ferrite phase are appropriately controlled, it is possible to obtain a cold-rolled ferritic stainless steel sheet having the specified formability and excellent surface appearance quality.

INDUSTRIAL APPLICABILITY

The material for a cold-rolled stainless steel sheet obtained by aspects of the present invention is suitably used as a material for a cold-rolled ferritic stainless steel sheet which are used for products manufactured by performing press forming involving mainly drawing and in applications in which high surface appearance quality is required such as kitchen equipment and eating utensils.

The invention claimed is:

1. A material for a cold-rolled stainless steel sheet, the material having a chemical composition containing, by mass %, C: 0.005% to 0.05%, Si: 0.02% to 0.75%, Mn: 0.1% to 1.0%, P: 0.04% or less, S: 0.01% or less, Cr: 16.0% to 18.0%, Al: 0.001% to 0.07%, N: 0.005% to 0.06%, and the balance being Fe and inevitable impurities, a metallographic structure including a martensite phase having an area ratio of 5% to 50% and the balance being a ferrite phase, and a waviness height is 2.5 μm or less, wherein a ferrite phase in portions extending from surface layers of front and back surfaces of a steel sheet to, in a thickness direction of the sheet, positions at t/3 (t: thickness of the sheet), has an average grain diameter of 20 μm or more and 50 μm or less, and a ferrite phase in a central portion in the thickness direction of the sheet, the central portion being a portion of the sheet other than the portions extending from, in the thickness direction of the sheet, the surface layers to the positions at t/3 (t: thickness of the sheet), includes a ferrite phase satisfying an aspect ratio of more than 3.0.

2. The material for a cold-rolled stainless steel sheet according to claim 1, the chemical composition further containing, by mass %, one, two, or more selected from among Cu: 0.1% to 1.0%, Ni: 0.1% to 1.0%, Mo: 0.1% to 0.5%, and Co: 0.01% to 0.3%.

3. The material of a cold-rolled stainless steel sheet according to claim 2, the material further comprising one, two, or more elements selected from, by mass, V: 0.01% to 0.25%, Ti: 0.001% to 0.015%, Nb: 0.001% to 0.030%, Mg: 0.0002% to 0.0050%, B: 0.0002% to 0.0050%, and REM: 0.01% to 0.10%.

4. The material for a cold-rolled stainless steel sheet according to claim 1, the chemical composition further containing, by mass %, one, two, or more selected from among V: 0.01% to 0.25%, Ti: 0.001% to 0.015%, Nb: 0.001% to 0.030%, Mg: 0.0002% to 0.0050%, B: 0.0002% to 0.0050%, and REM: 0.01% to 0.10%.

* * * * *